United States Patent [19]

Kusumi et al.

[11] Patent Number: 4,984,936

[45] Date of Patent: Jan. 15, 1991

[54] STOPPER APPARATUS FOR ROTARY REACTION FORCE

[75] Inventors: Hiroshi Kusumi; Satoshi Nozaki, both of Ibaraki; Muneo Yosida, Chiba, all of Japan

[73] Assignee: Hitachi Construction Machinery Co., Ltd., Tokyo, Japan

[21] Appl. No.: 378,559

[22] Filed: Jul. 10, 1989

[30] Foreign Application Priority Data

Jul. 19, 1988 [JP] Japan ..... 63-96252
Dec. 15, 1988 [JP] Japan ..... 63-162831
Dec. 23, 1988 [JP] Japan ..... 63-167227

[51] Int. Cl.[5] ..... E02D 11/00

[52] U.S. Cl. ..... 405/232; 173/163; 175/171; 405/233

[58] Field of Search ..... 405/232, 233, 133; 175/162, 113, 114, 121, 203, 195, 171; 173/163, 164, 152, 159, 141, 145, 32

[56] References Cited

U.S. PATENT DOCUMENTS 1,971,922 8/1934 Smith ..... 175/195
3,470,701 10/1969 Turzillo ..... 405/233
3,557,885 1/1971 Cales ..... 173/159
3,595,322 7/1971 Reimann ..... 173/163 X
3,645,343 2/1972 Mays ..... 175/171 X
3,756,330 9/1973 Russell ..... 175/162 X
4,126,193 11/1978 Brown ..... 175/171
4,221,269 9/1980 Hudson ..... 173/163
4,719,978 1/1988 Klemm ..... 175/171 X

FOREIGN PATENT DOCUMENTS 0077631 5/1985 Japan .
0088250 6/1985 Japan .
0293095 1/1971 U.S.S.R. ..... 405/240

*Primary Examiner*—Dennis L. Taylor
*Attorney, Agent, or Firm*—Sughrue, Mion, Zinn, Macpeak & Seas

[57] ABSTRACT

A stopper apparatus for neutralizing rotary reaction force set up by the rotation of a casing in an all-casing driver, comprises a long transmission frame for transmitting the reaction force, including a base frame connected to a casing drive unit and a joint frame one end of which is connected to the base frame, and a support frame horizontal- and vertical-rotatably connected to the other end of the joint frame. At least one side of the support frame comes in contact with a supporting mass by which the reaction force is supported. The stopper apparatus also comprises a pedestal for placing a working wagon thereon, detachably connected to the transmission frame, an inclination device for raising the pedestal to an inclined position, and an inter-frame distance increasing device for increasing the wedge of the pedestal.

26 Claims, 14 Drawing Sheets

STOPPER APPARATUS FOR ROTARY REACTION FORCE

BACKGROUND OF THE INVENTION

1. Field of the Invention

The present invention relates to an apparatus for neutralizing rotary reaction force set up by the driving of casings (i.e., large-diameter steel pipes used in foundation work in construction or earth moving operations) which are rotated or oscillated to be pressed into or pulled out of the soil ground by means of an all-casing driver most suitable for a method of cast-in-place operations.

2. Prior Art

An all-casing excavation work is a typical method of cast-in-place pile operations.

Two types of apparatus are currently used to neutralize rotary reaction force for all-casing drivers In one type of such apparatus, a hole is made in the base frame of the all casing driver and an H-shaped beam is inserted through the hole into the ground so that the rotary reaction force set up by the rotation of the casing is neutralized by the supporting force of the ground. In the other type of stopper apparatus, a frame is mounted around the all-casing driver and a counterweight is placed on the frame so that the rotary reaction force can be neutralized by the mass of the counterweight. The first type of stopper apparatus is not suitable for use in those cases where machinery is installed on an asphalt or concrete foundation. Examples of the second type of stopper apparatus are described in Unexamined Published Japanese Utility Model Application Nos. 61-193141 and 61-206740 and they are characterized by neutralizing the rotary reaction force of an all casing driver with a center-drill excavator placed on a frame connected to the driver.

The apparatus described in these publications have an inclinable cylinder by means of which the end of the pedestal of the apparatus adjacent to the all-casing driver is raised to an inclined position The pedestal is not inclined when a center-drill excavator is to be placed on it. When ready-mixed concrete is to be filled into the excavated hole after excavation has been completed, the end of the pedestal adjacent to the all-casing driver is raised so as to act as a sloping guide path for a mixer wagon.

The basic construction of these prior art apparatus is shown in FIG. 1. The pedestal 11 of the stopper apparatus for rotary reaction force is connected to an all-casing driver 1 and a center-drill excavator 10 for performing excavating operation through a casing 100 is placed on the pedestal 11. The all-casing driver 1 generally consists of a base frame la held horizontally by means of jacks 1*e*, an annular frame 1*c* capable of vertical movement along the base frame 1*a* by means of thrust cylinders 1*b*, and a casing retainer 1*d* with clamps that is mounted on the frame 1*c* and which is rotatable by such means as a motor. The casing 100 chucked by the clamps on the casing retainer 1*d* is pressed into the ground with the retainer 1*d* being rotated or swung with a motor or some other means and with the thrust cylinders 1*b* being contracted. The soil and sand in the casing 100 are excavated out and removed by means of either a bucket 205 on the earth drill shown as the excavator 10 or a hammer grab bucket. In order to pull out the casing 100, the casing which remains chucked by the clamps on the retainer 1*d* is pushed up with the retainer being rotated or swung and with the thrust cylinders 1*b* being extended If the excavator 10 is placed on the pedestal 11, it will effectively absorb the rotational reactive movement that occurs when the casing 100 is being pressed into or pulled out of the ground. The excavator 10 will also serve as a weight when the casing 100 is being pressed into the ground.

The apparatus having the construction described above are capable of satisfactorily absorbing the reaction force that develops when the casing is pressed into the ground. However, in order to neutralize the rotary reaction force, the construction of these apparatus dictates that the counterweight should be located in an area fairly close to the excavated hole. In other words, a considerably heavy counterweight must be used but depending on the area of the site, there has been a limit on the load that can be applied. Under certain work conditions, there is no need to install the pedestal 11 that serves both as the support of an excavator and as the ramp to guide a mixer wagon.

The apparatus described above have an inclining cylinder 210 on each side of the apparatus that inclines the pedestal so that it can be used as a ramp for guiding a mixer wagon when filling the concrete into the excavated hole. In addition, the frame on which the inclining cylinders are mounted has such a construction that its position cannot be changed depending upon whether a center-drill excavator is used or not, and this inevitably causes the frame to extend considerably far beyond the width of the all-casing driver unit. In certain cases where the excavator is not placed on the pedestal but the pedestal is put against the side of one of the crawlers of the excavator and where the concrete is to be filled into the excavated hole near the border of the site, the inclining cylinders will get in the way and make it impossible to bring the all-casing driver unit to approach the boarder to one half the width of the unit. In order to get around the small site limit, it has been necessary to make some alteration in the layout of machines, for example, positioning them slantwise.

Further, excepting the conventional apparatus described above, particularly in Europe, there has been well known an apparatus in which an all-casing driver is integrally attached to a running body of a center-drill excavator. However, such an apparatus has the disadvantage that it cannot neutralize too large rotary reaction force because the distance from the center of excavation to the center of gravity of the center-drill excavator cannot be increased.

SUMMARY OF THE INVENTION

An object, therefore, of the present invention is to provide a stopper apparatus capable of neutralizing the rotary reaction force set up by the rotation of the casing of an all casing driver with a small supporting force and in a reliable manner without being influenced by the conditions of the working ground.

Another object of the present invention is to provide an stopper apparatus for neutralizing the rotary reaction force of an all-casing driver that allows the casing to be pressed into or pulled out of the ground in a limited working area since it is equipped with a ramp or sloping platform for guiding a mixer wagon that can be mounted or dismounted depending upon the conditions of the work.

The first object of the present invention can be attained by a stopper apparatus that has an elongated transmission frame mounted on the all-casing drive unit, with a reaction force receiving portion being disposed at the front end of the frame with which a rotary reaction force supporting mass is brought into contact.

The second object of the present invention can be attained by a stopper apparatus that comprises a transmission frame consisting of a base frame coupled to the all-casing driver unit and an exchangeable long joint frame coupled with a pin or pins that are inserted through the base frame, and a support frame pin coupled to said joint frame via a spherical bearing.

The stopper apparatus of the present invention may be equipped with a detachable pedestal having inclination means and inter-frame distance increasing means.

When a casing is rotationally driven into the ground by means of the all-casing driver unit, the reaction against the rotational excavating force must be supported. According to the present invention, this rotary reaction force is received by the front end of the long transmission frame mounted on the all-casing driver unit, so compared to the conventional method that places a counterweight on the pedestal to neutralize the rotary reaction force, the loading point is sufficiently distant from the center of excavation so that the tangential force is reduced to enable supporting of the rotary reaction force by a smaller force.

The present invention has the added advantage that a single unit of stopper apparatus for rotary reaction force is applicable under all working conditions by either changing the length of the joint frame or mounting or dismounting the pedestal.

DETAILED DESCRIPTION OF THE PREFERRED EMBODIMENTS

Figure 1:
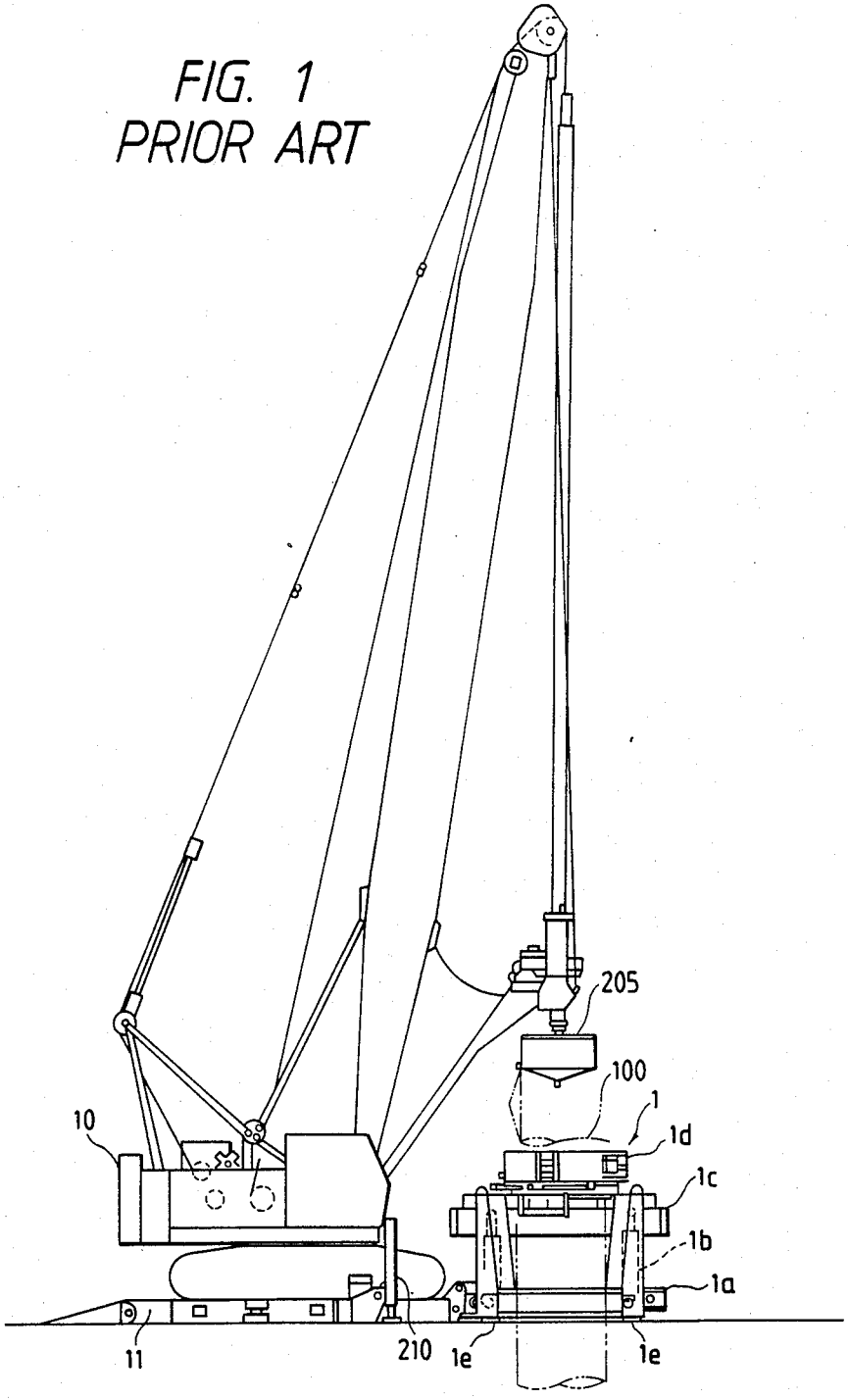
FIG. 1 PRIOR ART
FIG. 1 is a side view of a prior art stopper apparatus for rotary reaction force of all-casing drivers.
Figure 2:
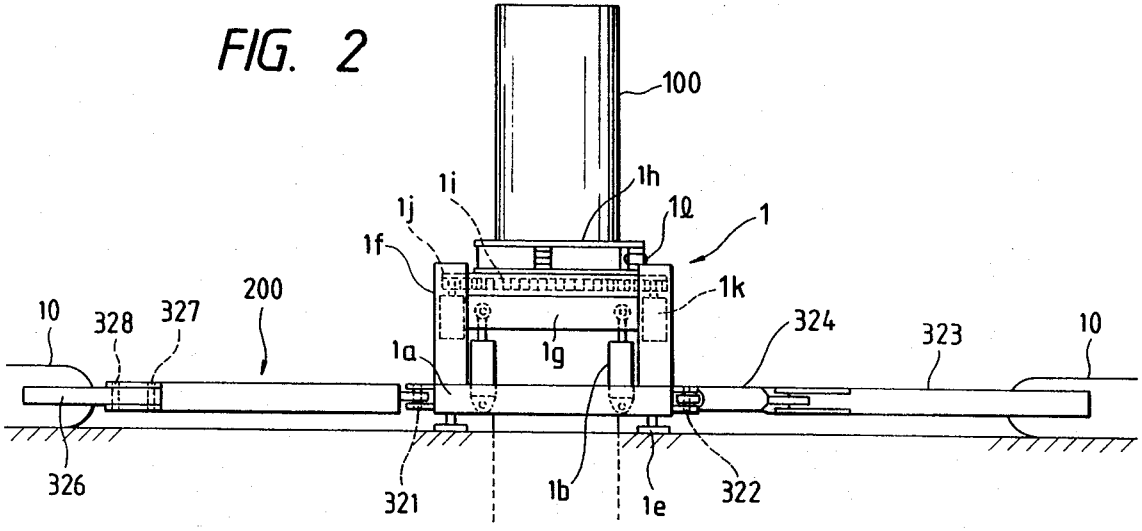
FIG. 2 is a front view of a stopper apparatus for rotary reaction force mounted on an all-casing driver unit according to a first embodiment of the present invention.
Figure 3:
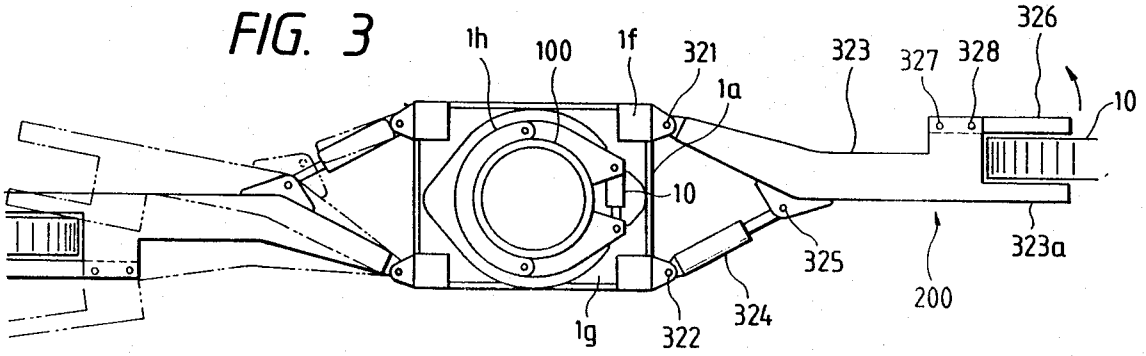
FIG. 3 is a plan view of the apparatus shown in FIG. 2.

A first embodiment of the present invention is described hereinafter with reference to FIGS. 2 and 3. A all-casing driver 1 by which a casing 100 is pressed into or pulled out of the ground comprises a base frame 1*a* which position is adjusted to a horizontal level by means of jack cylinders 1*e*, a rotary driver 1*g* that is vertically slidable along guide posts 1*f* at the four corners of the base frame 1*a* by means of thrust cylinders 1*b* whose base ends are secured to the base frame 1*a*, and a holding unit 1*h* secured to the rotary side of the rotary driver 1*g*. The rotary driver 1*g* comprises a swivel bearing 1*i* with outer teeth, a pinion 1*j* that rotates the bearing 1*i*, and a hydraulic motor 1*k* with a planetary reduction gear for driving the pinion 1*j*, with the holding unit 1*h* being secured to the outer race which is the rotor of the swivel bearing 1*i*. The casing 100 is chucked or released by means of a clamp cylinder 1 secured to the clamp unit 1*h*.

A stopper apparatus for rotary reaction force 200 comprises a transmission frame 323 whose base end is mounted pivotally on the base frame 1*a* with a vertical pin and which has at its front end a portion 323*a* that receives a unindirectional rotary reaction force, a hydraulic cylinder 324 connected between the transmission frame 323 and the base frame 1*a* by pins 322 and 325, and a reaction force receiving bracket 326 that faces the portion 323*a* and which is secured to the front end of the transmission frame 323 by pins 327 and 328. Thus, the portion 323*a* and bracket 326 combine at the front end of the transmission frame 323 to form a reaction force receiving fork that holds a crawler 10 which works as a rotary reaction force supporting mass. Two units of the stopper apparatus for rotary reaction force 200 having the construction described above are disposed symmetrically with respect to the all-casing driver unit 1.

The casing 100 is chucked with the clamp cylinder 1 of the holding unit 1*h*. When the hydraulic motor 1*k* with a planetary reduction gear mounted on the rotary driver 1*g* is driven, the swivel bearing 1*i* with outer teeth is rotated by the rotational movement of the pinion 1*j*. As a result, the holding unit 1*h* secured onto the outer race of the swivel bearing 1*i* is rotated. When the thrust cylinders 1*b* are contracted, the driver 1*g* descends along the guide posts 1*f*. When the casing 100 starts to be driven rotationally into the ground, a need arises to support the reaction force against the rotational force of excavation. To meet this need, the reaction force is first supported by the guide posts 1*f*, then transmitted to the base frame 1*a*, thence transmitted to the stopper apparatus 200 via pins 321 and 322. The apparatus 200 is so constructed that a crawler 10 of a center-drill excavator which makes a pile hole by excavating out the soil and sand in the casing 100 is held by the reaction force receiving fork composed of the combination of the portion 323*a* and bracket 326 at the front end of the transmission frame 323. Thus, unless the crawler 10 skids laterally, the rotary reaction force set up by the rotation of the casing in the all-casing driver unit 1 can be effectively supported by the stopper apparatus 200. Thus, compared to the prior art system in which a frame is mounted around the all-casing driver unit 1 and a counterweight is placed on the frame to balance the rotary reaction force that develops in the driver unit, the stopper apparatus according to the first embodiment of the present invention which has a loading point far distant from the center of excavation has the advantage that the tangential force is sufficiently reduced to ensure that the rotary reaction force can be effectively neutralized by the force of friction that is developed against the ground by the counterweight of the center-drill excavator alone. When the crawler 10 is to be held by the reaction force receiving fork a, wooden splint is often used to avoid any damage to the crawler 10. The crawler 10 may be fitted into the reaction force receiving fork by running the excavator, but this procedure is time-consuming since it requires that the crawler's travelling direction be changed several times. Instead of this, the following procedure is employed in the embodiment under discussion: the pin 328 is first pulled out of the bracket 326 and the bracket is pivoted about the pin 327 counterclockwise as shown in FIG. 3; then, the hydraulic cylinder 324 is extended to cause the transmission frame 323 to pivot about the pin 321 until the portion 323*a* at the front end of the transmission frame 323 comes in contact with the crawler 10 (if necessary, a wooden splint may be inserted without forming any gap; thereafter, the bracket 326 is returned to its initial position and the pin 328 is inserted to secure the bracket to the transmission frame 323. In this case, too, a wooden splint may be inserted between the bracket 326 and the crawler 10 Since the bracket 326 is readily movable by hand, a wooden splint of an appropriate thickness can be easily inserted to avoid gap formation.

As described above in the stopper apparatus according to the first embodiment of the present invention, the crawler 10 is held by the reaction force receiving fork at the front end of the transmission frame 323, so the apparatus is applicable not only to balance a unidirectional rotary reaction force but also to balance the swing reaction force of a swing casing driver that performs cyclic rotations in forward and reverse directions. When using a all-casing driver to make a foundation for pylons in a mountainous site, there sometimes occurs a need to make a hole by excavating the ground not with a center-drill excavator on crawlers but with a hammer grab attached to a crane fixed on a setting. In this case, it is necessary to neutralize the rotary reaction force with the front end of the transmission frame 323 abutting against one of the legs of the setting. To do this, the all-casing driver unit 1 is installed on a predetermined excavating position, the hydraulic cylinder 324 is extended, and the procedures employed to hold the crawler 10 are repeated; as a result, the reaction force receiving fork of the device 200 can be readily brought into engagement with the selected leg, thereby ensuring that the rotary reaction force set up by the rotation of the casing in the all-casing driver unit 1 is effectively supported. A tree on the site can also be held easily by repeating the same procedure. If the supporting mass is a fixed one, very cumbersome procedures are generally involved in installing the all-casing driver unit 1 at the excavating position However, the apparatus according to the first embodiment of the present invention which rotates the transmission frame 323 by means of the hydraulic cylinder 324 is capable of reliable and efficient operations by separating the installation work from the fixation to the reaction force supporting mass. When working at corners of the site, the stopper apparatus 200 may be installed on only one side of the all-casing driver unit 1 in order to get around the space limit, or alternatively, two units of the apparatus may be positioned symmetrically with respect to the all-casing driver unit 1 as in the embodiment under discussion in order to cancel the tangential force and to reduce the working radius of the excavator.

The present invention is in no way limited to the embodiment described above and a fixed transmission frame may be employed without using the hydraulic cylinder 324. The reaction force receiving fork formed at the front end of the transmission frame 323 will fulfill its function as long as it is integral with the frame.

As described above, according to the first embodiment of the present invention, the raction force set up by the rotation of the casing in the all-casing driver unit is removed at the front end of a long transmission frame, so that the rotary reaction force supporting point can be established at a distance from the excavating center of the all-casing driver and the tangential force is sufficiently reduced to enable neutralizing of the rotary reaction force by a smaller force.

Figure 4:
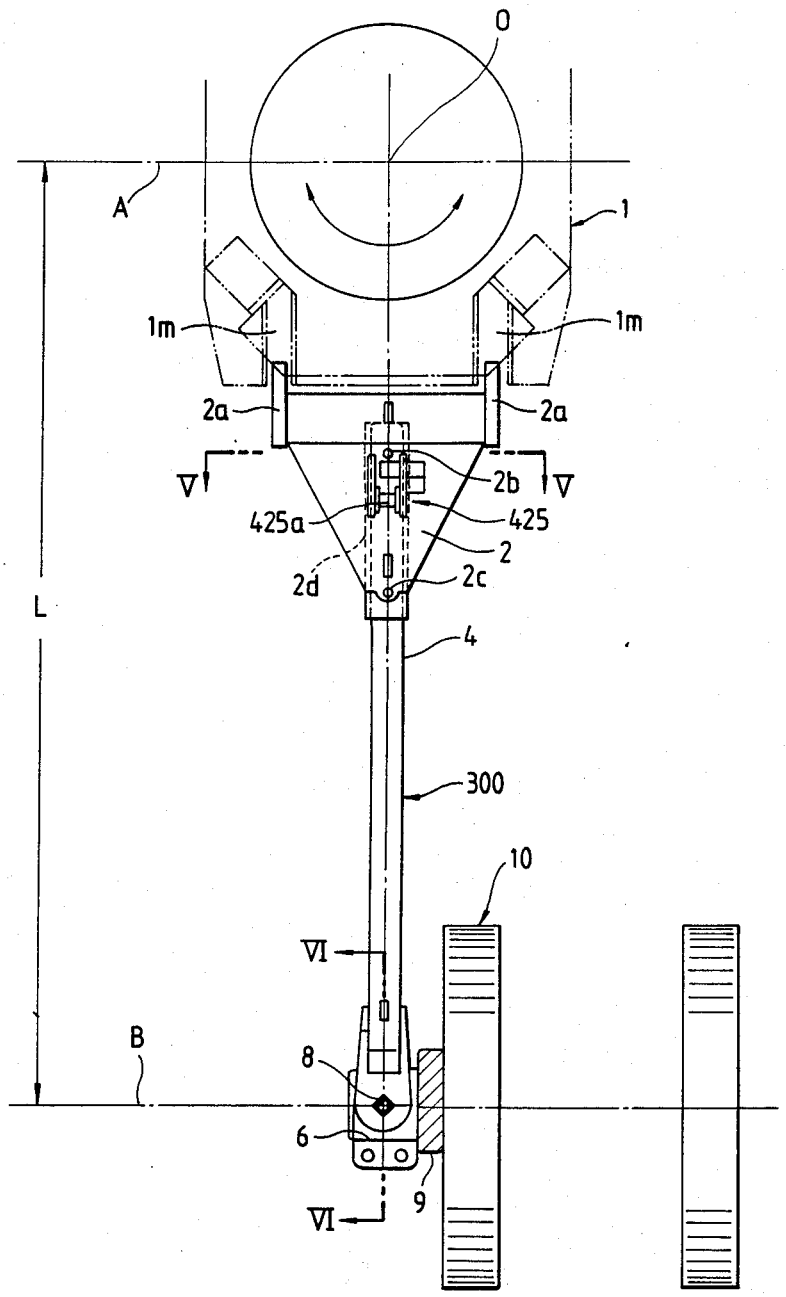
FIG. 4 is a plan view of a stopper apparatus for rotary reaction force according a second embodiment of the present invention.

A second embodiment of the present invention is described hereunder with reference to FIGS. 4 to 13. FIG. 4 shows the basic construction of the second embodiment Receptacles 1*m* on opposite sides of one end of the all-casing driver unit 1 receive brackets 2*a* that are provided on opposite sides of the base frame 2 of a long transmission frame 300 and which are coupled to the driver unit with an upper and a lower pin (not shown). The transmission frame 300 comprises the base frame 2 and a long joint frame 4 the base end of which is coupled to the base frame 2 by joint pins 2*b* and 2*c*.

Figure 6:
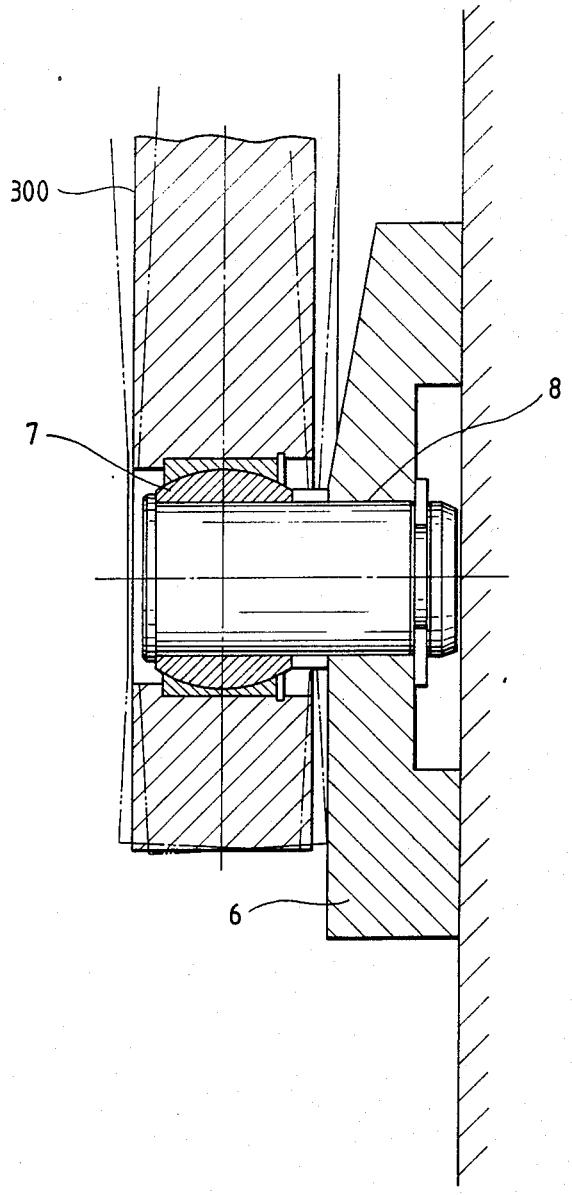
FIG. 6 shows an enlarged section of the apparatus of FIG. 4 as viewed in the direction indicated by arrows VI.

At the front end of the transmission frame 300, a support frame 6 is provided in such a way that it is capable of horizontal rotation and vertical swing by way of a pin 8 and a universal joint 7 as shown in FIG. 6.

The stopper apparatus for rotary reaction force having the basic construction described above is held in contact with a supporting mass such as a center-drill excavator 10 on the right or left lateral side or both lateral sides of the support frame 6, with a splint 9 being interposed therebetween Even if the casing 100 is given rotary or swing (oscillating) force by the all-casing driver 1, the resulting rotary reaction force will be transmitted from the base frame 2 through the long joint frame 4, support frame 6 and splint 9 so that it is easily neutralized by the center-drill excavator 10. The apparatus of the basic construction described above has no direct ramp for guiding a mixer wagon, so if concrete is to be filled into the excavated hole, a concrete pumping wagon may be employed. Alternatively, a ramp may be mocked up in a direction 90 or 180 degrees offset from the stopper apparatus for rotary reaction force. If desired, a ramp (sloping platform) for guiding a mixer wagon may be installed on the apparatus as in a third embodiment of the invention to be described later in this specification.

Figure 5:
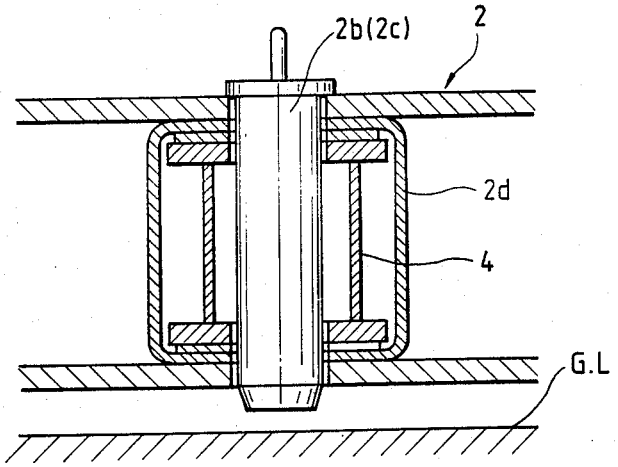
FIG. 5 shows a section of the apparatus of FIG. 4 as viewed in the direction indicated by arrows V.
Figure 7:
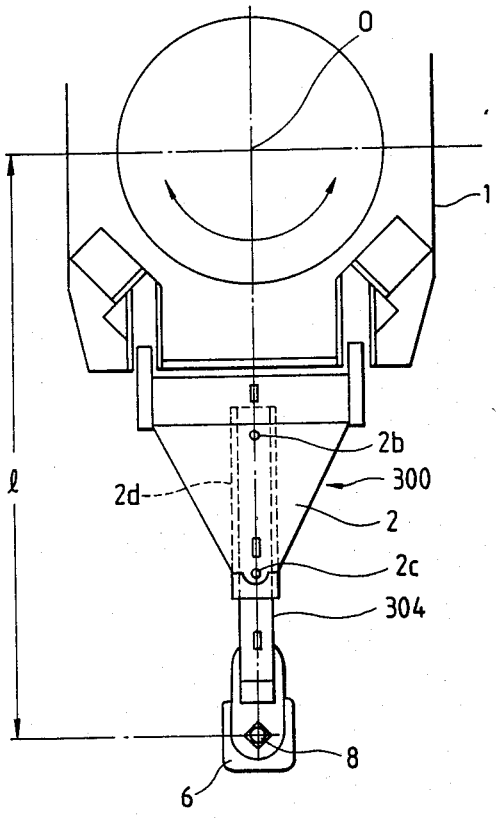
FIG. 7 is a plan view of a stopper apparatus that employs a short joint frame.

In the stopper apparatus for rotary reaction force of FIG. 4, a jacket of a rectangular cross section 2*d* is provided in the longitudinal direction of the base frame 2 as shown in FIG. 5. A joint frame of a selected length, for example, a long joint frame as shown by 4 in FIG. 4 or a sort joint frame as shown by 304 in FIG. 7, is inserted into the jacket 2*d* and fixed by joint pins 2*b* and 2*c*. Hence, by removing joint pins 2*b* and 2*c*, the joint frame 4 or 304 can be easily disconnected from the base frame 2.

On a working site having a wide space, the long joint frame 4 is inserted into the jacket 2*d* in the base frame 2 mounted on the all-casing driver unit 1 as shown in FIG. 4 and the frame 4 is fixed by inserting pins 2*b* and 2*c* to make the transmission frame 300.

According to this construction, the distance from the center 0 of the rotation of the all-casing driver to the rotary reaction force supporting point can be increased to L. If the all-casing driver is rotated or swung about the center 0 in the direction indicated by arrows, the resulting rotary reaction force is transmitted through the transmission frame 300 having the long joint frame 4 and absorbed by the support frame 6, thereby enabling a great rotary reaction force to be balanced with a small supporting force. Hence, a lightweight supporting mass need be placed in intimate contact with the lateral side of the support frame 6 in order to ensure that the casing can be pressed into or pulled out of the ground in a consistent way.

Figure 8:
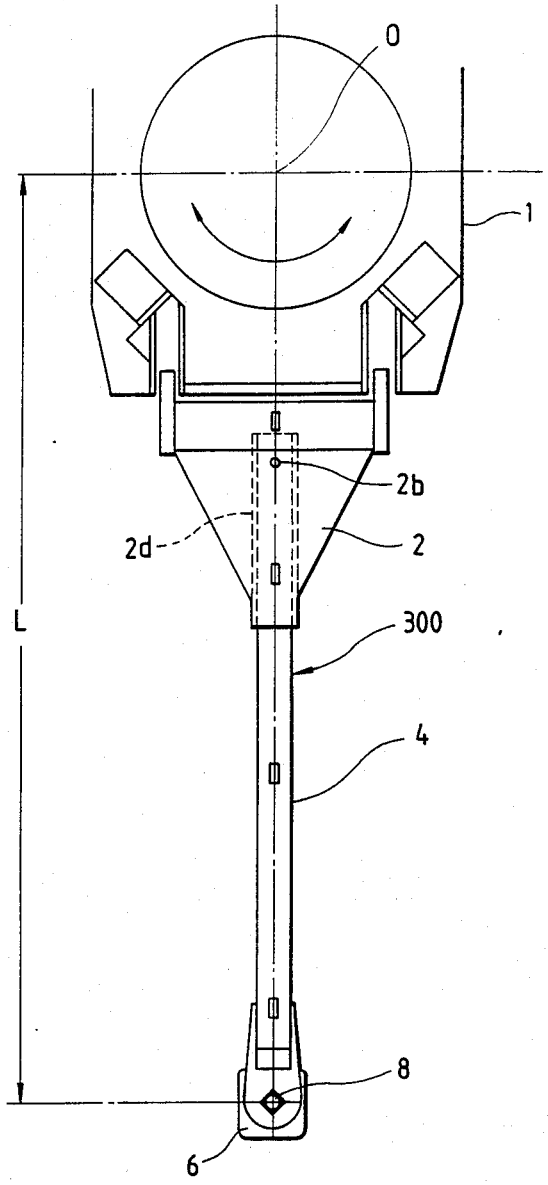
FIGS. 8 and 9 are plan views showing modifications of the apparatus of FIG. 4.

On a working site having a limited space, the short joint frame 304 is inserted into the jacket 2*d* as shown in FIG. 8 and fixed by inserting joint pins 2*b* and 2*c* to make the transmission frame 300. According to this construction, the distance from the center 0 of the rotation of the all-casing driver to the rotary reaction force supporting point can be shortened to (see FIG. 7). If the all-casing driver is rotated or swung about the center 0 in the direction indicated by arrows, the resulting rotary reaction force is transmitted through the transmission frame 300 having the short joint frame 304 and absorbed by the support frame 6. If, as in the prior art, a center-drill excavator is located in intimate contact with the lateral side of the support frame 6, the casing can be pressed into or pulled out of the ground in a consistent way.

As described above, joint frames of different lengths are kept in stock and if the actual working situation permits, a long joint frame is selectively used to enable a great rotary reaction force to be neutralized by a small supporting force.

FIG. 8 shows a modification of the stopper apparatus shown in FIG. 4. According to this modification, the base frame 2 and the joint frame 4 are connected by a single joint pin 2*b* and the rotary reaction force developed by the rotation or swinging of the casing is transmitted by way of the surface of lateral contact between the jacket 2*d* and the joint frame 4.

As described above, according to the second embodiment of the present invention, the transmission frame, which is the major component of the stopper apparatus for balancing the rotary reaction force of a all-casing driver, consists of two separate elements, one being the base frame having a jacket with a rectangular cross section disposed in the longitudinal direction thereof, and the other being a joint frame of a selected length which is detachably inserted into said jacket. According to this construction, the distance from the center 0 of the rotation of the all-casing driver to the rotary reaction force supporting point can be easily changed to ensure that the rotary reaction force developed as a result of the driving of the casing is balanced by a small supporting force as required depending upon the working situation.

In the construction described above, the base frame 2 may be integrally formed with the joint frame 4 by welding.

Even if jack cylinders 1*e* are operated to position the all-casing driver unit 1 horizontally, the support frame 6 which is coupled to the joint frame 4 by the universal joint 7 and the pin 8 as described above is capable of supporting the rotary reaction force without making any uneven contact with the lateral side of one of the two crawlers of the center-drill excavator 10.

In the second embodiment described above, the support frame 6 is connected to the front end of the transmission frame 30 through the pin 8 and the universal joint 7 so that the rotary reaction force is supported at the support frame through the splint 9 by the center-drill excavator 10. However, in the case where cast-in-place pile operation is carried out on the substantial horizontal foundation, the rotary reaction force may be neutralized by the center-drill excavator 10 arranged on the lateral side of the front end of the transmission frame 300 via the splint without the provision of the support frame 6.

Figure 9:
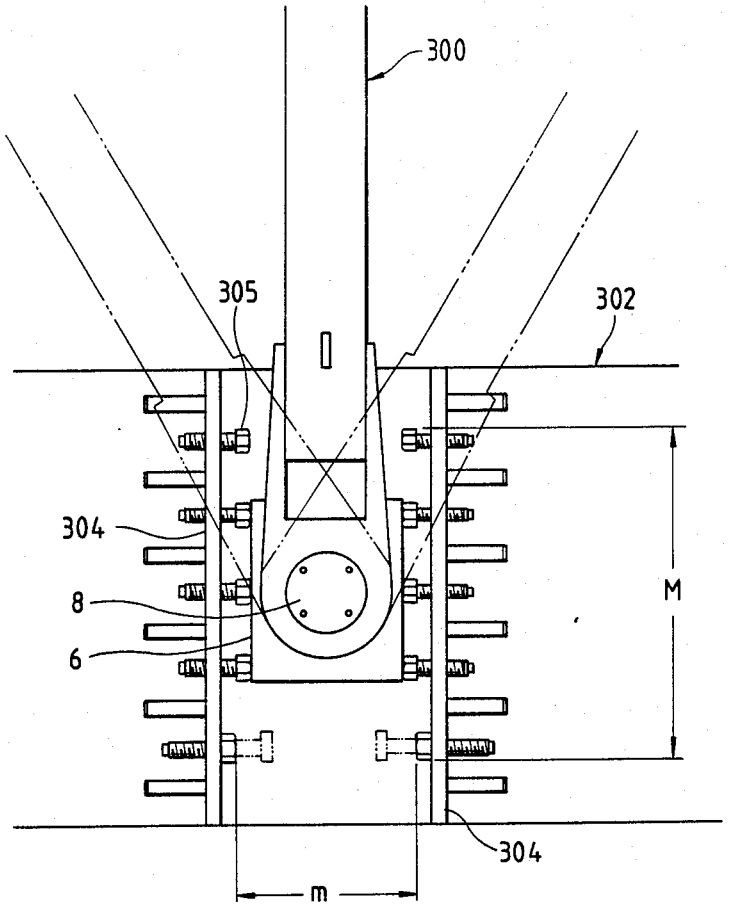

FIG. 9 shows another modification of the stopper apparatus shown in FIG. 4. A frame (also called a pedestal) 302 is fixed by placing on it a supporting mass such as a center-drill excavator. A pair of spaced brackets 304 for holding the support frame 6 are provided on the fixed frame 302. The distance between the support frame 6 and each of the brackets 304 is adjusted by a plurality of fasteners, say, bolts 305, that are provided retractably, for example by threading, on the brackets 304. As shown in FIG. 9, the support frame 6 can be held by a plurality of bolts 305 in such a way that the lateral sides of the frame are confined within the range of m in a direction perpendicular to the length of the transmission frame 300. The support frame 6 can be held by at least two bolts 305 on either side thereof in such a way that the end faces of the frame are confined within the range of M in the longitudinal direction of the transmission frame 300.

In order to change the position of the all-casing driver unit 1 within the area of the working site, the pins 2*b* and 2*c* are removed from the transmission frame 300 with the support frame 6 remaining connected thereto, and the all-casing driver unit 1 is moved with the base frame 2 remaining coupled thereto This enables the long transmission frame 300 to be transferred with one part being separated from the other part. After placing the all-casing driver unit 1 at a predetermined position, the joint frame 4 with the support frame 6 is connected to the base frame 2 by inserting pins 2*b* and 2*c*, thereby reconstructing the transmission frame 300 equipped with the support frame 6. In the next step, the frame 302 is located at a predetermined position and fixed by placing a supporting mass such as an excavator.

Subsequently, the support frame 6 is held in position by means of a plurality of bolts 305 threaded into the pair of brackets 304 as shown in FIG. 9. The transmission frame 300 is freely rotatable about the pin 8 (see FIG. 6) in the horizontal direction with respect to the support frame 6. Therefore, even if the line A which passes through the center 0 of the rotation of the all-casing driver unit 1 and which is perpendicular to the transmission frame 300 as shown in FIG. 4 and the line B which passes through the center 0 and which is also perpendicular to the transmission frame 300 are not parallel to each other as in the case where the transmission frame 300 swings to a greatly offset position from the support frame 6 as indicated by one-long-and-two-short dashed lines in FIG. 9, the transmission frame 300 can be effectively coupled to the fixed frame 302 Further, the transmission frame 300 can swing in a direction perpendicular to the pin 8 by means of the universal joint (spherical bearing) 7 as shown in FIG. 6, so that the stopper apparatus for rotary reaction force according to the second embodiment of the present invention can be positioned even on a sloping ground.

As described above, by holding the transmission frame by means of a plurality of fasteners mounted on the fixed frame, the two members can be coupled together without requiring exact registry, thus enabling the transmission frame to be connected or disconnected in a simple manner. In addition, the support frame is mounted at one end of the transmission frame in such a way that it is capable of horizontal rotation and vertical swinging and the support frame is held by the plurality of fasteners. This enables the rotational reactive movement removing device of the present invention to be easily located even on a sloping ground or other unfavorable working sites.

Figure 10:
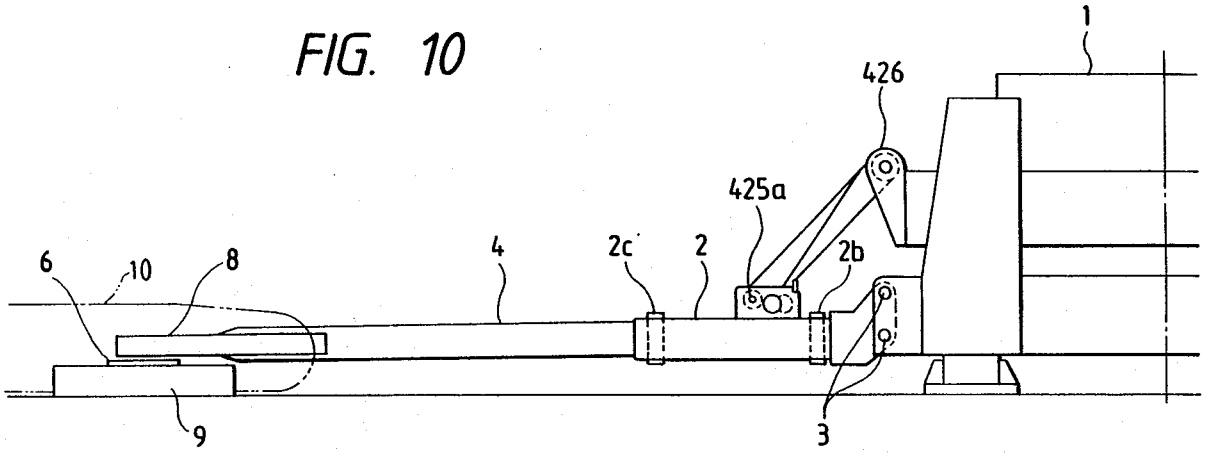
FIG. 10 is a side view of the apparatus of FIG. 4 in its operating position.
Figure 11:
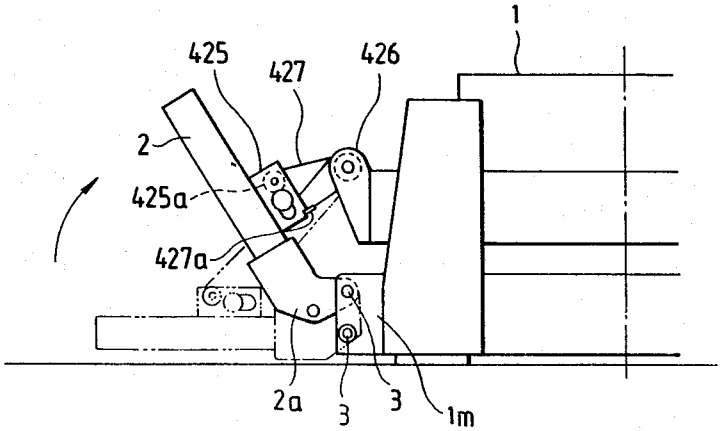
FIG. 11 is a partial side view of the apparatus of FIG. 4 in its transport position.

FIGS. 10 and 11 are side views showing the stopper apparatus of FIG. 4 in a working and a transport position, respectively. Brackets 2*a* secured to opposite sides of the base frame 2 of the long transmission frame 300 are inserted into receptacles 1*m* disposed on opposite sides of an end of the all-casing driver unit 1, and are coupled to these receptacles by an upper and a lower connecting pin 3. A winch 425 having a drum 425*a* is disposed on the base frame 2 and a sheave 426 is secured to the all-casing driver unit 1. A wire rope 427 unwound from the drum 425*a* on the winch 425 is wound onto the sheave 426, with an end thereof being in engagement with the frame of the winch 425. Thus, base frame 2 is constructed in such a way that if one of the two pins 3 is removed from the all-casing driver unit 1, the frame 2 is vertically pivotal about the other pin 3.

If the operator wants to move the all-casing driver unit 1 from one excavating position to another within the area of the working site, the following procedures may be followed. First, pins 2*b* and 2*c* are removed to disconnect the base frame 2 from the joint frame 4. Then, as shown in FIG. 11, one of the pins 3 is removed and the winch 425 is driven to wind up the wire rope 427 onto the drum 425*a*, whereupon the base frame 2 pivots about the other pin 3 in the direction indicated by the arrow to move from the working position indicated by the one-long-and-two-short dashed line to the transport position indicated by the solid line which is close to the all-casing driver unit 1. As a result, it becomes possible to transport the base frame 2 by hoisting together with the all-casing driver unit 1.

Figure 12:
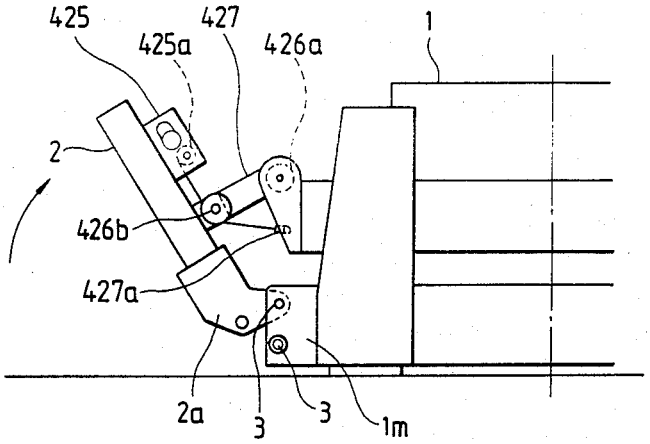
FIGS. 12 and 13 are partial side views showing modifications of the apparatus of FIG. 4 in its transport position, respectively.
Figure 13:
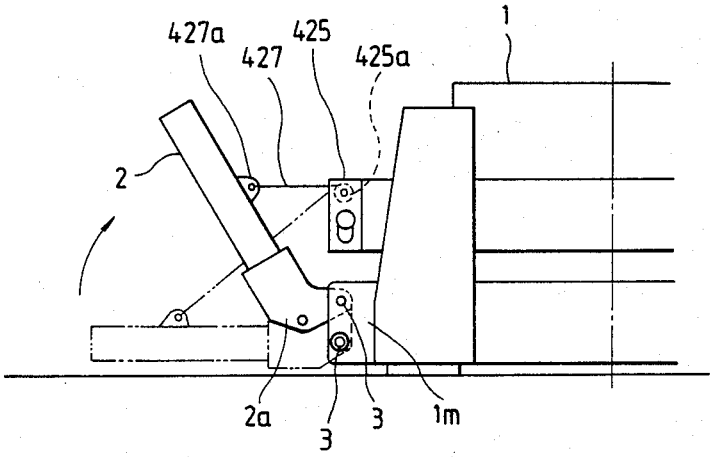

FIGS. 12 and 13 are side views showing other modifications of the stopper apparatus of FIG. 4 in its transport position as in FIG. 11. In FIG. 12, the sheave 426 is composed of two sheave blocks 426*a* and 426*b* which are secured to the all-casing driver unit 1 and the base frame 2, respectively, and the wire rope 427 unwound from the drum 425*a* are wound onto each of the sheave blocks, with an end thereof 427*a* being in engagement with the all-casing driver unit 1. In FIG. 13, the winch 425 is secured to the all-casing driver unit 1 and the wire rope 427 has its end 427*a* brought into engagement with the base frame 2.

The above description of the second embodiment of the present invention assumes the use of the splittable long transmission frame 300 but it should of course be understood that a solid transmission frame may also be used effectively.

According to the construction described above, the transmission frame which is the major component of the stopper apparatus for balancing the rotary reaction force that accompanies the driving of a casing is so designed that it is pivotal about one of the connecting pins mounted on the all-casing driver unit and that by unwinding the wire rope from the winch disposed either on the transmission frame or on the casing driver unit, the transmission frame is allowed to pivot in a direction approaching the all-casing driver unit until it comes to the transport position This construction offers the following advantages. First, not only the all-casing driver unit but also the transmission frame can be hoisted within the space allotted for hoisting the all-casing driver unit alone. In other words, the transmission frame while it is connected to the all-casing driver unit can be transported without requiring any large hoisting space. This enables packing of the casing driver unit and the transmission frame in a compact form, thereby facilitating their transportation. Secondly, even a long transmission frame can be transported together with the all-casing driver unit if it is fabricated as a splittable component.

Figure 14:
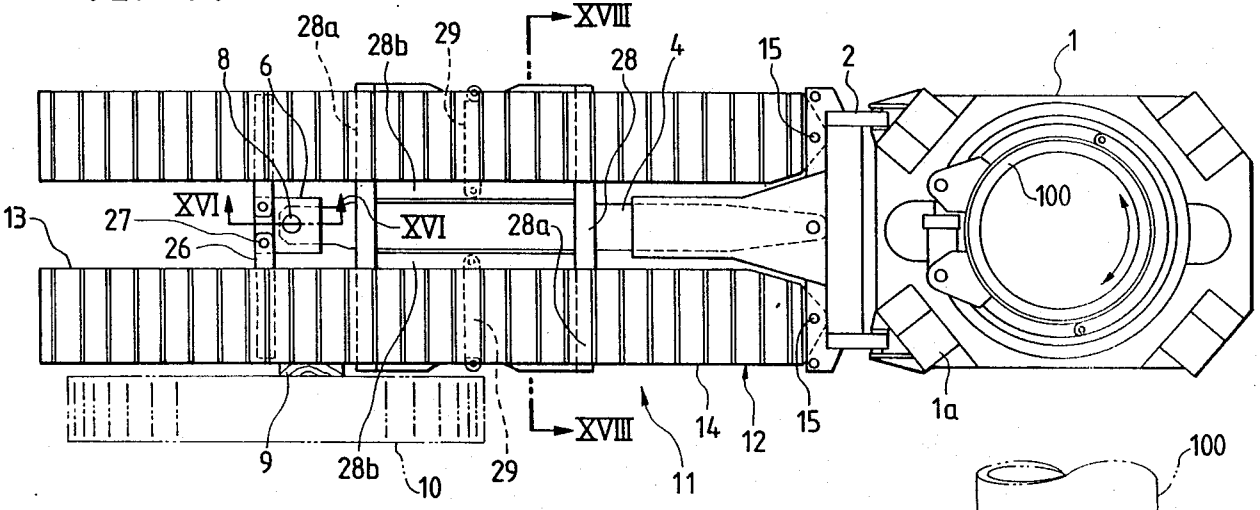
FIG. 14 is a plan view of a stopper apparatus for rotary reaction force according to a third embodiment of the present invention which supports the rotary reaction force by means of a pedestal mounted to serve as a ramp for guiding a mixer wagon.
Figure 15:
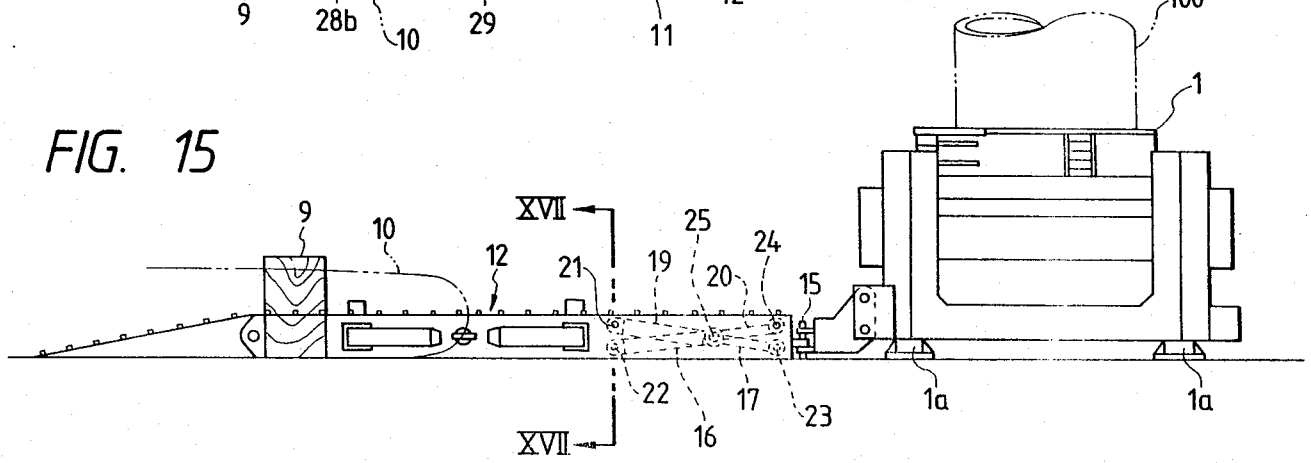
FIG. 15 is a side view of FIG. 14.
Figure 16:
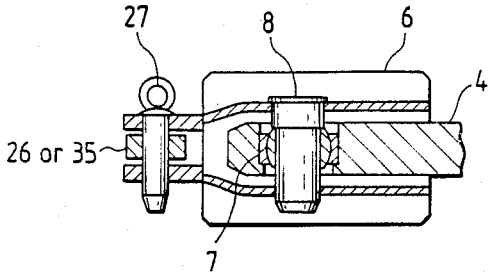
FIG. 16 shows a section of FIG. 14 as viewed in the direction indicated by arrows XVI.
Figure 17:
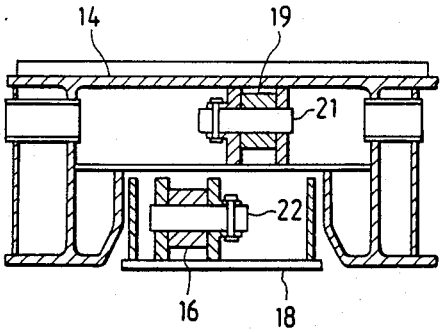
FIG. 17 shows a section of FIG. 15 as viewed in the direction indicated by arrows XVII.
Figure 18:
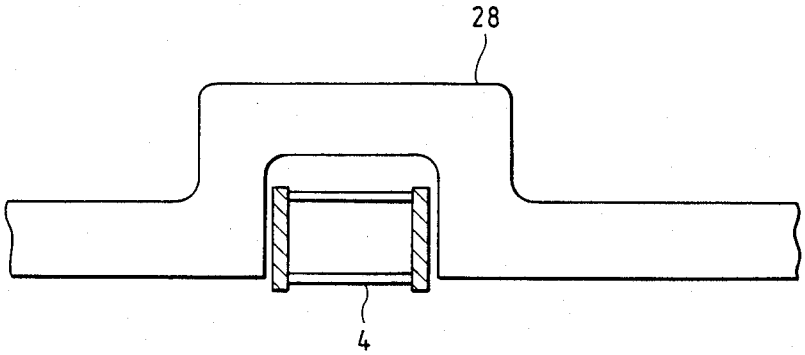
FIG. 18 shows a section of FIG. 14 as viewed in the direction indicated by arrows XVIII.
Figure 19:
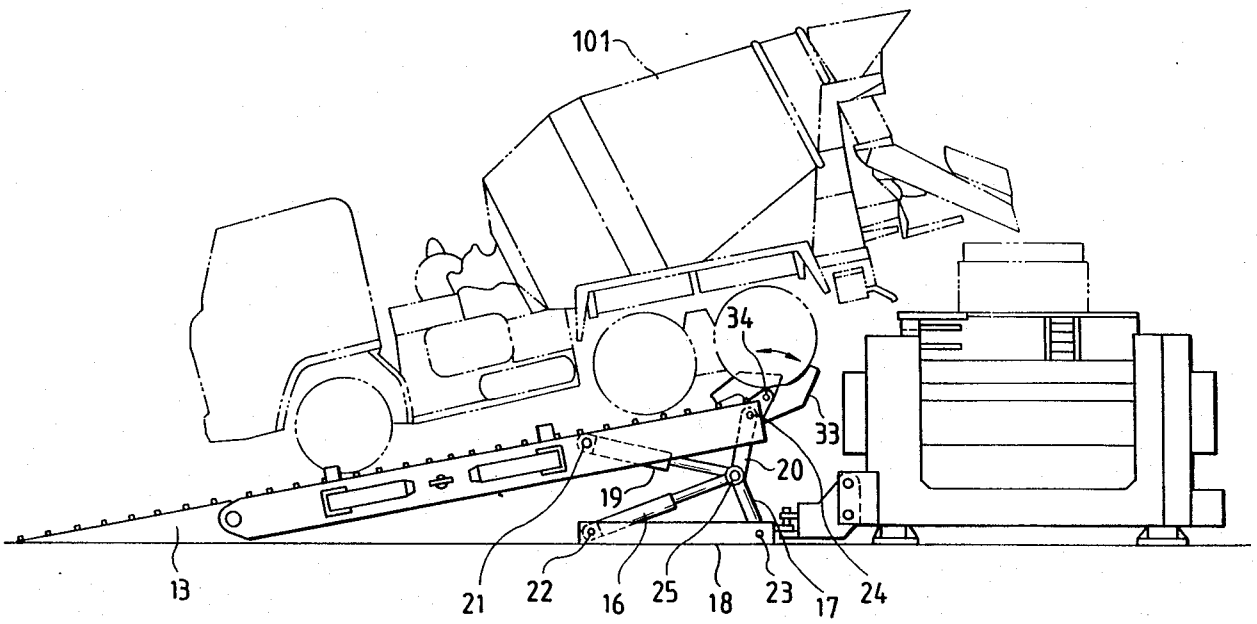
FIG. 19 is a side view of FIG. 14 showing a mixer wagon that has climbed on the inclined pedestal.

FIGS. 14 to 22 show a third embodiment of the present invention which consists basically of the stopper device shown in FIG. 4 plus a pedestal on which a center-drill excavator can be placed and which also serves as a ramp for guiding a mixer wagon. As shown in FIG. 14, the pedestal indicated by 11 consists of side frames 12 and guide frames 28. Each of the side frames 12 consists of a tail frame 13 positioned at the start point for a mixer wagon 101 or center-drill excavator 10 to climb on the pedestal 11, a frame 14 which is inclined when the mixer wagon 101 climbs up, and a base plate 18 that is coupled to the base frame 2 by a pin and that has hydraulic cylinder 16 and a link 17 built in for elevating the inclinable frame 14. As shown in FIGS. 17 and 19, the inclinable frame 14 also has a hydraulic cylinder 19 and a link 20 built in. One end of the hydraulic cylinder 19 is coupled to the inclinable frame 14 by a pin 21; one end of the hydraulic cylinder 16 is coupled to the base plate 18 by a pin 22; one end of the link 17 is coupled to the base plate 18 by a pin 23; and one end of the link 20 is coupled to the inclinable frame 14 by a pin 24. The other end of each hydraulic cylinder is coupled to the other end of each link by a pin 25.

A shaft 26 couples the tail frames 13 to the inclinable frames 14 and is fixed to the tail frames so that it will not be displaced in an axial direction. The shaft 26 is shaped like a fork which is inserted into the support frame 6 and coupled by pins 27 as shown in FIG. 16. The forked portion of the shaft 26 has a metal touch that prevents its pivoting about the pins 27.

Each of the guide frames 28 is inserted into the inclinable frame 14 on both sides and as shown in FIG. 18, the central portion of each guide frame is raised to ride over the joint frame 4. The guide frames 28 are composed of two beams 28*a* that are spaced from the joint frame 4 and two beams 28*b* which connect the beams 28*a*. The beams 28*b* are connected to the respective inclinable frames 14 by hydraulic cylinders 29.

Figure 20:
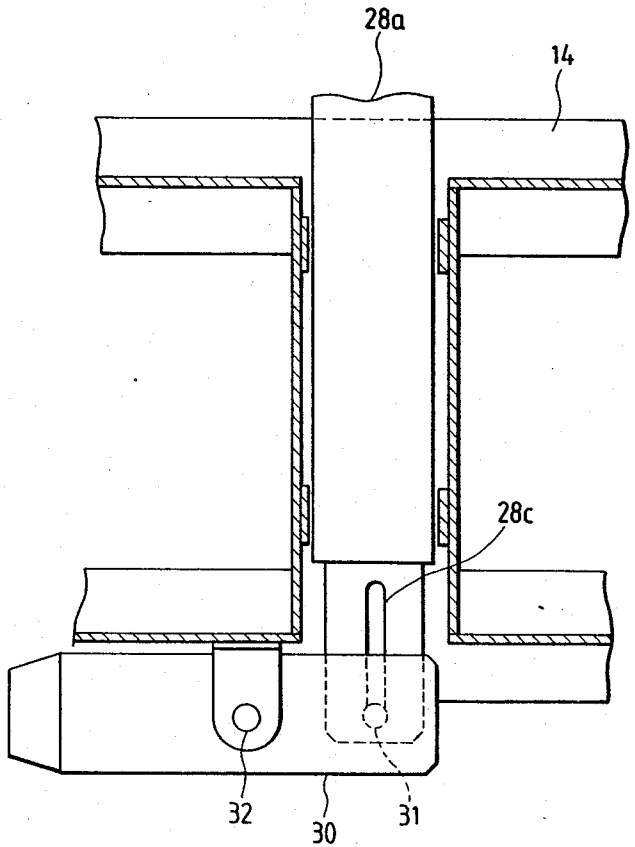
FIG. 20 shows a side frame that is pin-coupled to a bend extension beam mounted at the front end of a guide frame.

As shown in FIG. 20, an extension beam 30 is coupled to one end of each beam 28*a* by a pin 31 and secured to the inclinable frame 14 by a pin 32. The pincoupled end of the beam 28*a* meshes in fork shape with the extension beam 30 and has an elongated slit 28*c* though which the pin 31 is to be inserted Thus, by inserting the pins 31 and 32 through opposite ends of the slit, the extension beam 30 can be aligned linearly with respect to the beam 28*a* without kinking. As shown in FIG. 14, the size of the extension beam 30 is so determined that it will not exceed greatly the total width of the casing driver unit 1 when the beam is folded.

The wheel block 33 shown in FIG. 19 is provided in order to ensure that the mixer wagon 101 will not go beyond the ramp or sloping platform The pin 34 shown in FIG. 19 is provided to secure the wheel block 33 to the side frames 12 and the wheel block 33 can be disconnected by removing this pin. Only one pin is used to fix the wheel block 33, so the rear wheels of the mixer wagon 101 riding on the wheel block 33 can be supported in a reliable manner since the wheel block 33 establishes a surface touch with the side frames 12. If the side frames 12 are lowered, the wheel block 33 may contact the base frame 2 but it will not be damaged at all since it is pivotal about the pin 34.

Figure 22:
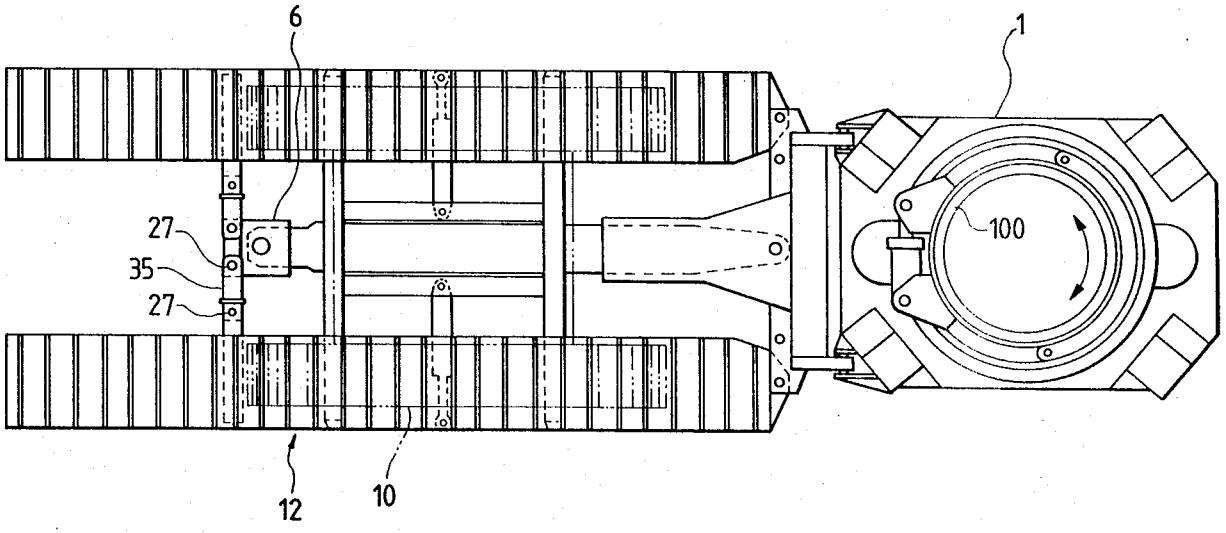
FIG. 22 shows side frames the inter-frame distance of which has been increased.

The extension shaft 35 shown in FIG. 22 is an optional element that may be used to fill the gap that may form between the shaft 26 and the base frame 6 when the distance between opposite side frames 12 is increased by the action of hydraulic cylinders 29.

As will be apparent from FIGS. 14 to 19, in normal excavating operations, the rotary reaction force generated will be transmitted from the base frame 2 to the side frames 12 either by a route consisting of the joint frame 4, support frame 6 and shaft 26 or directly through the connecting pins 15 to the base frame 2 Hence, the rotary reaction force can be supported by a center-drill excavator 10 which is placed in intimate contact with one set of side frames 12 via a splint 9.

The pins 27 for mounting the shaft 26 are offset from the pin 8 inserted through the support frame 6, so the joint frame 4 inserted into the support frame 6 will swing about the pin 8 over a relatively limited range of angles. The base frame 2 is also connected with a relatively large allowance to the base plate 18 for the side frames by means of pins 16. Further, a great gap is also provided between the joint frame 4 and each of the guide frames 28. For these reasons, the jack cylinders 1*a* may be operated to control the position of the all-casing driver unit 1 without causing any effect on the crawler which is held in intimate contact with one set of side frames 12.

To make a ramp or sloping platform for guiding the mixer wagon 101, the hydraulic cylinders 16 and 19 are extended in such a way that the links 17 and 20 fixed by pins 23 and 24 are gradually unfolded to form a nearly straight line. As the links are unfolded, so are the inclinable frames 14 elevated to make a ramp or sloping platform for the mixer wagon 101. In order to ensure that the base plate 18 will establish intimate and stable contact with the ground surface, the links 17 and 20 are so designed that they will not form a completely straight line even if the hydraulic cylinders 16 and 19 are extended to the fullest As a result, the counterweights of the mixer wagon 101, inclined frames 14 and guide frames 28 are partly transmitted via pin 25 and distributed as a compressive load between the link 17 and hydraulic cylinder 16. The position of the pin 25 is so determined that the centers of gravity of the mixer wagon and each of the frames 14 and 28 are offset from the pin 25 toward the tail frames 13 As for the side frames 12, the extension beam 30 provided at the pincoupled end of each guide frame 28 is bent as shown in FIG. 20 and the guide frame 28 is coupled to each side frame 12 by the hydraulic cylinder 29, and these contribute to increased safety since the side frames remain stable during the wagon's climbing up on the inclined frames 14.

Figure 21:
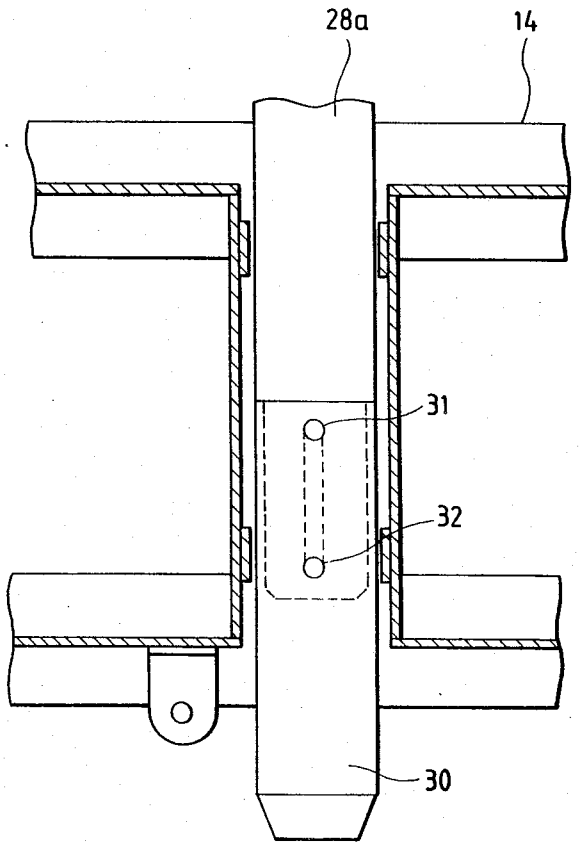
FIG. 21 shows the side frame which is disengaged from the extension beam so that it is securely fixed to a beam of the guide frame.

FIGS. 21 and 22 show an embodiment for the case where a excavating operation is performed with a center-drill excavator 10 placed on the pedestal 11. The pin 32 (see FIG. 20) is removed from the extension beam 30 so that it comes out of engagement with the side frame 12. If the free extension beam 30 is swung through 90 degrees and pushed toward the side frame 12, the pin 31 will be displaced along the elongated slit 28*c* in the beam 28*a*. When the pin 31 reaches the farther end of the slit, the pin 32 is inserted through the other end, whereupon the extension beam 30 and the beam 28*a* are brought into alignment and the straight line thus formed will remain stable. Subsequently, the pins 15 connecting the base plate 18 to the base frame 2 are removed, and so are the pins 27 that connect the support frame 6 to the shaft 26. Thereafter, the hydraulic cylinders 29 are extended to the fullest, whereupon the inter frame distance between the side frames 12 is increased with the two beams 28*a* and extension beams 30 on the guide frames 28 being used as guides. The pin 15 for fixing the base plate 18 is inserted into the other pair of holes made in the base frame 2. At the same time, an extension shaft 35 is inserted to fill the gap that has formed between the shaft 26 and the support frame 6 and coupled to these members by pins 27. Subsequently, the center-drill excavator 10 is placed on the side frames 12 so that the force of friction between each side frames and the ground surface will be sufficiently increased to support the rotary reaction force from the all-casing driver unit 1 Even if the all-casing driver unit 1 generates a sidewise reaction force as a result of oscillatory driving of the casing, the shaft 26, extension shaft 35, hydraulic cylinders 29 and pins 15 will effectively prevent the side frames 12 from widening and thus insure safety because the excavator 10 will not be dislodged from the side frames 12.

As described above, according to the third embodiment of the present invention, the rotary reaction force generated from the driving of a casing can be effectively neutralized with a single unit of the stopper apparatus for rotary reaction force if a proper combination of components that matches a specific working condition is selected from a variety of choices, and this contributes to a reduction in the initial cost.

Since the apparatus for inclining the pedestal to form a ramp or sloping platform which guides a mixer wagon is built in the side frames, the inter frame distance between the side frames can be reduced to a minimum value that is equal to the width of the all-casing driver unit, with one of the crawlers of a center-drill excavator being placed in intimate contact with one set of the side frames in order to neutralize the rotary reaction force This enables excavating work to be done in an area close to the border of the site without being limited by the size of the stopper apparatus for rotary reaction force.

As described on the foregoing pages, according to the first aspect of the present invention, a long transmission frame is mounted on the all-casing driver unit and a mass for supporting the rotary reaction force that is developed by the driving of a casing is brought into contact with the front end of this transmission frame, so the loading point is kept sufficiently distant from the excavating center to enable the rotary reaction force to be supported by a small force.

According to the second aspect of the present invention, the transmission frame described above is composed of a base frame and a joint frame having a selected length. Since a long joint frame can be exchanged for a short joint frame or vice versa depending upon the working space available, the device is applicable to working under all conditions that might be encountered.

According to the third aspect of the present invention, a pedestal that serves as a ramp or sloping platform for guiding a mixer wagon is provided detachably. This pedestal is capable of supporting the rotary reaction force by a small force and at the same time, it can be used both as a support for a center-drill excavator and as a ramp or sloping platform for guiding a mixer wagon. The stopper apparatus of the present invention is therefore applicable to working even in a limited space.

Further, the pedestal described above has an apparatus built in for inclining it, so that the interframe distance of the pedestal can be reduced to a minimum value that does not exceed the width of the all-casing driver unit. As a result, cast-in-place pile operation can be easily accomplished without limitation even if the working condition is unfavorable as exemplified by the case where cast-in place pile operation have to be performed in an area close to the border of the site or where the site has a limited space.

While the present invention has been described hereinabove with reference to the three specific embodiments, it should of course be understood that the present invention is in no way limited to these embodiments alone and that various modifications and changes can be made without departing from the spirit and scope of the invention.

What is claimed is:

1. A stopper apparatus for neutralizing rotary reaction force set up by the rotation of a casing in a casing driver, comprising:

at least one elongated transmission frame for transmitting the rotary reaction force, one end of said transmission frame being connected to a casing driver unit, and an opposite end thereof being supported by a rotary reaction force supporting mass, said rotary reaction force supporting mass being disposed at a position remote with respect to said casing driver unit such that said rotary reaction force is received by said opposite end of said elongated transmission frame and in turn by said rotary reaction force supporting mass.

2. A stopper apparatus as claimed in claim 1, wherein said one end of said transmission frame is pivotally connected to said casing driver unit, and said opposite end thereof includes reaction force receiving means which comes in contact with said rotary reaction force supporting mass.

3. A stopper apparatus as claimed in claim 1, wherein said rotary reaction force supporting mass comprises a crawler.

4. A stopper apparatus as claimed in claim 2, wherein two units of said transmission frame is so provided as to be positioned symmetrically with respect to said all-casing driver unit.

5. A stopper apparatus as claimed in claim 2, further comprising a hydraulic cylinder which is connected between said casing driver unit and said transmission frame.

6. A stopper apparatus as claimed in claim 2, wherein said reaction force receiving means is of a fork shape.

7. A stopper apparatus as claimed in claim 1, wherein said transmission frame comprises:

a base frame connected to said casing driver unit; and an elongated joint frame one end of which is connected to said base frame, an opposite end of said joint frame is supported by said supporting mass.

8. A stopper apparatus as claimed in claim 7, further comprising:

a support frame connected to said opposite end of said joint frame, said support frame being supported by said supporting mass.

9. A stopper apparatus as claimed in claim 8, further comprising connector means for horizontal-rotatably and vertical-swingably connecting said opposite end of said joint frame to said support frame 10. A stopper apparatus as claimed in claim 9, wherein said connector means comprises a universal joint and a pin for connecting said opposite end of said joint frame to said support frame through said universal joint.

11. A stopper apparatus as claimed in claim 7, wherein said base frame is connected to said casing driver unit by at least two pins.

12. A stopper apparatus as claimed in claim 7, further comprising means for detachably fixing one end of said joint frame to said base frame.

13. A stopper apparatus as claimed in claim 12, wherein said fixing means comprises a jacket provided on said base frame in the longitudinal direction thereof, one end of said joint frame being inserted into said jacket, and at least one pin for fixing said joint frame to said base frame through said jacket.

14. A stopper apparatus as claimed in claim 13, wherein said jacket is of a rectangular cross section.

15. A stopper apparatus as claimed in claim 7, wherein said base frame is integrally formed with said joint frame by welding.

16. A stopper apparatus as claimed in claim 8, further comprising a fixed frame which is fixed by mounting said supporting mass; and fastener means for connecting said support frame to said fixed frame.

17. A stopper apparatus as claimed in claim 16, wherein said fastener means comprises a pair of brackets provided on said fixed frame so as to put said support frame therebetween, and a plurality of bolts forward and backward movably attached to said bracket for holding said support frame.

18. A stopper apparatus as claimed in claim 11, further comprising a winch disposed on one of said transmission frame and said casing driver unit, and a wire rope wounded on said winch in which a pair of said pins is provided for fixing one end of said base frame to said casing driver unit, and when one of said pins is removed from said casing driver unit, said transmission frame is vertically pivotal about the other pin by unwinding said wire rope from said winch.

19. A stopper apparatus as claimed in claim 8, further comprising a pedestal for placing a working wagon thereon, said pedestal being detachably attached to said transmission frame and said support frame.

20. A stopper apparatus as claimed in claim 19, further comprising inclining means for raising said pedestal to a predetermined inclined position.

21. A stopper apparatus as claimed in claim 20, further comprising inter-frame distance increasing means for increasing the width of said pedestal.

22. A stopper apparatus as claimed in claim 21, wherein said inclining means is installed in said pedestal whereby when the width of said pedestal is minimized, said pedestal is equal or less in width than said casing driver unit.

23. A stopper apparatus as claimed in claim 21, wherein said inclining means comprises:

a pair of tail frames positioned at the start point for said working wagon to climb on said pedestal;

a pair of inclinable frames which is inclined when said working wagon climbs up;

a base plate on the ground; and elevator means provided between said inclinable frame and said base plate for elevating said inclinable frame.

24. A stopper apparatus as claimed in claim 23, wherein said elevator means comprises hydraulic cylinders and links.

25. A stopper apparatus as claimed in claim 21, wherein said inter-frame distance increasing means comprises:

a pair of first frames connected between said pair of inclinable frames, respectively;

a pair of second frames connected between said pair of first frames, respectively; and a pair of hydraulic cylinders connected between said pair of inclinable frames and said pair of second frames, respectively.

26. A stopper apparatus as claimed in claim 20, further comprising a pair of wheel block provided on the tip of said pair of inclinable frames at the side of said casing driver unit, respectively.

* * * * *